US006049922A

United States Patent [19]

Gleason

[11] Patent Number: 6,049,922

[45] Date of Patent: Apr. 18, 2000

[54] SOLID-SEDIMENT RETAINMENT PLUMBING TRAP

[76] Inventor: John F. Gleason, 401 S. College St., Denham Springs, La. 70726

[21] Appl. No.: 09/391,896

[22] Filed: Sep. 7, 1999

Related U.S. Application Data

[60] Provisional application No. 60/104,048, Oct. 13, 1998.

[51] Int. Cl.[7] ..... E03C 1/282; E03C 1/29

[52] U.S. Cl. ..... 4/681; 4/679; 137/247.45; 137/247.51; 137/546; 210/515

[58] Field of Search ..... 4/679–681, DIG. 14; 137/247.45, 247.49, 247.51, 546; 210/515, 537

[56] References Cited

U.S. PATENT DOCUMENTS

| | | | |
|---|---|---|---|
| 292,055 | 1/1884 | Riker | 4/681 |
| 4,676,900 | 6/1987 | Masihy et al. | 210/537 |
| 4,961,842 | 10/1990 | Schulz et al. | 137/546 |
| 5,159,724 | 11/1992 | Vosper | 4/679 |
| 5,953,772 | 9/1999 | Morrissey | 4/680 |

FOREIGN PATENT DOCUMENTS

| | | | |
|---|---|---|---|
| 528802 | 4/1957 | Belgium | 4/681 |

*Primary Examiner*—Charles R. Eloshway
*Attorney, Agent, or Firm*—Reginald F. Roberts, Jr.

[57] ABSTRACT

A solid-sediment retainment plumbing trap devised primarily for a sink from which substantial amounts of solid material are discharged; e.g., eyeglass manufacture and dental plastic grinders. The plumbing trap is connected to the sink, and collects sediment in a bottle having a fill line. When sediment collecting in the bottle reaches the fill line, the bottle is exchanged for a similar bottle, and the plumbing trap is once again in service. Because the bottle is connected to the rest of the trap by threads, bottle exchange is rapid and easy.

12 Claims, 5 Drawing Sheets

SOLID-SEDIMENT RETAINMENT PLUMBING TRAP

CROSS-REFERENCE TO RELATED APPLICATION

This application is a non-provisional application for the subject matter disclosed by my provisional application 60/104,048, filed Oct. 13, 1998.

BACKGROUND OF THE INVENTION

The present invention relates to plumbing. More particularly, the invention relates to a plumbing trap for a sink from which a high concentration of solids is discharged.

Most households are equipped with U-shaped pipe traps, commonly known as P-traps, beneath sinks in kitchens and bathrooms, for trapping water and thereby preventing sewer gases from entering the house. Such traps work very well in residential households. For sinks servicing eyeglass manufacturers and dental plaster grinders this is not the case. In these and similar applications involving a high concentration of particulate solids, there is a frequent and regular need to empty and/or replace the traps, due to an accumulation of sediment therein. To be economical, the operation of emptying and changing out the plumbing trap must be easily and quickly performed. In the present state of the art, the traps must be dismantled in a time-consuming operation. A need therefore exists for a different kind of plumbing trap for this type of service. The present invention provides such a trap.

SUMMARY OF THE INVENTION

In general, the present invention in a first aspect provides a plumbing trap for a sink from which a high concentration of solids is discharged. The trap comprises (a) a vessel for receiving material discharged from the sink, and for separating the material into a lower solid phase and an upper liquid phase; (b) a first passageway connecting the sink and the vessel to one another; (c) a second passageway for conveying the upper liquid phase from the vessel; and (d) means for connecting the vessel to the second passageway and for disconnecting the vessel therefrom. In a first embodiment the vessel includes a level indicator for indicating the appropriate level to be reached by the lower solid phase before changing out the vessel. In a second embodiment the trap includes means for draining the upper liquid phase from the vessel, the first passageway, and the second passageway.

In a second aspect the invention provides a method for trapping solids in water discharged from a sink before the water is conveyed to a sewer system. The method comprises (a) providing a vessel for receiving the water and solids discharged from the sink, and for separating the water and solids into a lower solid phase and an upper liquid phase; (b) providing a level indicator for the vessel, for indicating the appropriate level to be reached by the lower solid phase before changing out the vessel; (c) conveying the water and solids from the sink to the vessel; and (d) conveying the upper liquid phase from the vessel.

DETAILED DESCRIPTION OF THE INVENTION

Figure 1:
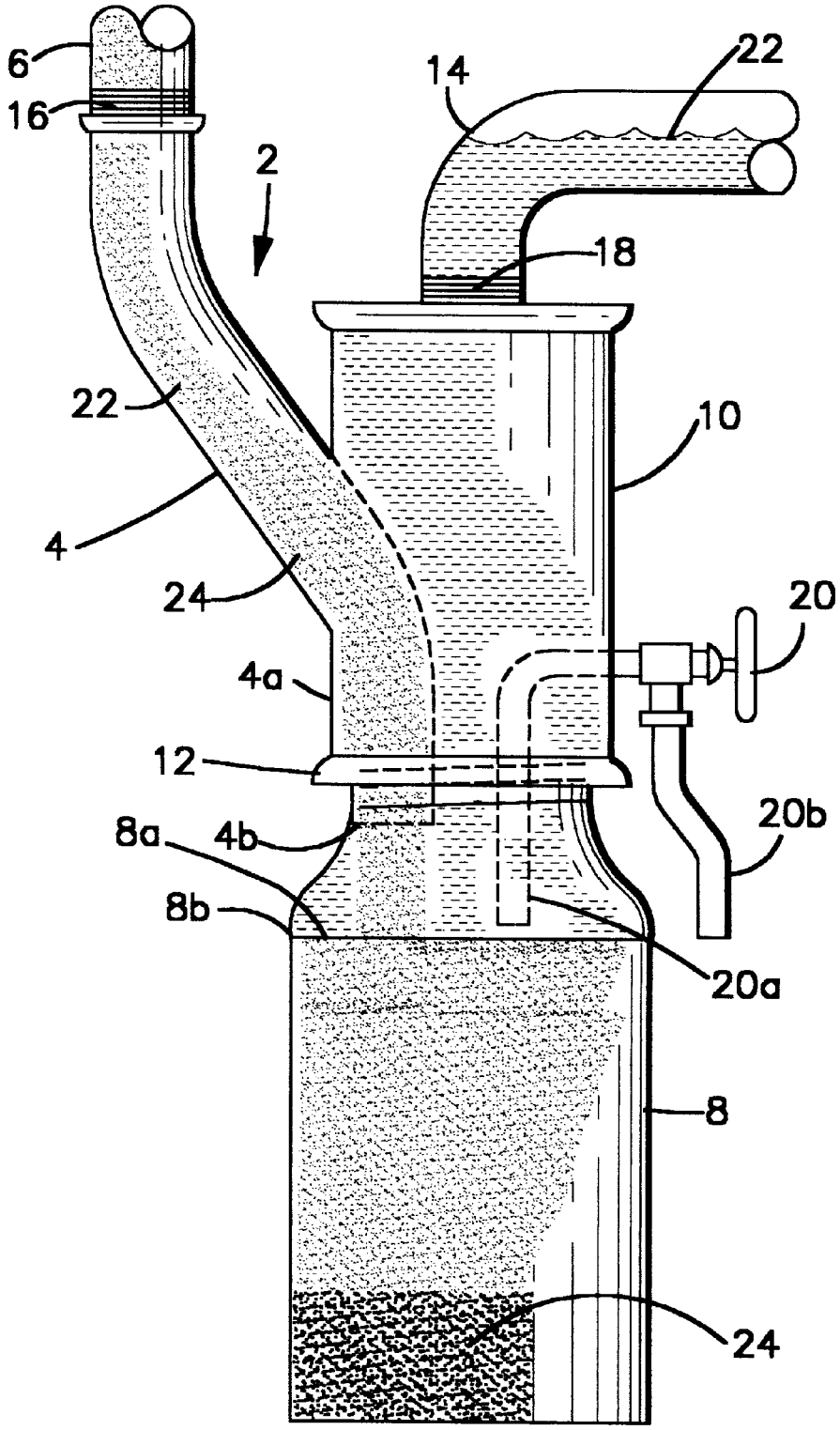
FIG. 1 is a schematic representation of a plumbing trap, made in accordance with the principles of the present invention, showing material discharged from a sink flowing into the plumbing trap.

More specifically, reference is made to FIGS. 1–5, in which is shown a solid-sediment retainment plumbing trap, made in accordance with the principles of the present invention, and generally designated by the numeral 2.

The plumbing trap 2 comprises a first passageway 4, a second passageway 10, and a transparent or translucent bottle 8 having a fill line 8*a* inscribed thereon. By inscribed is meant included in the bottle 8, whether by marking, etching, indentation, or other means.

The first passageway 4 conveys water 22 and entrained solids 24 from a sink (not shown) to the bottle 8. The second passageway conveys clear water away from the bottle 8, leaving a residue 24 of solids which have settled to the bottom of the bottle 8. The lower portion 4*a* of the first passageway 4 projects into the second passageway 10, where it forms a common wall with the second passageway 10. An extension 4*b* of the first passageway 4 extends downward into the upper portion 8*b* of the bottle 8.

The bottle 8 is connected to the first and second passageways 4 and 10 by threads 12 on the bottle 8, the second passageway 10, and the lower portion 4*a* of the first passageway 4. The first and second passageways 4 and 10 are connected to first and second pipes 6 and 14 by threads 16 and 18.

It will be apparent to those skilled in the art that means other than threads could be used to connect the bottle 8 to the first and second passageways 4 and 10. For example, a stopper could be placed in the mouth of the bottle 8, and the first and second passageways 4 and 10 could be inserted through the stopper. Actually, any connecting means that are rapid and reversible may be employed. In general, however, thread means are preferred.

A valve 20, a siphon line 20*a*, and a drain line 20*b* are used to drain the plumbing trap 2, by opening the valve 20. The siphon line 20*a* is disposed within the bottle 8 and the second passageway 10. The valve 20 and the drain line 20*b* are disposed externally of the bottle 8 and the second passageway 10. The valve 20 connects the siphon line 20*a* and the drain line 20*b* to one another.

Reference is now made to FIG. 1, which shows water 22 and entrained solids 24 flowing into the trap 2 from a sink (not shown) through the first pipe 6 and the first passageway 4, and water 22 flowing out of the trap 2 to a sewer system (not shown) through the second passageway 10 and the second pipe 14. Solids 22, usually in the form of particles, settle out in the bottle 8 to form a sediment 24 in the bottom of the bottle 8. Clear water 22 flows out of the bottle 8 into the second passageway 10.

Figure 2:
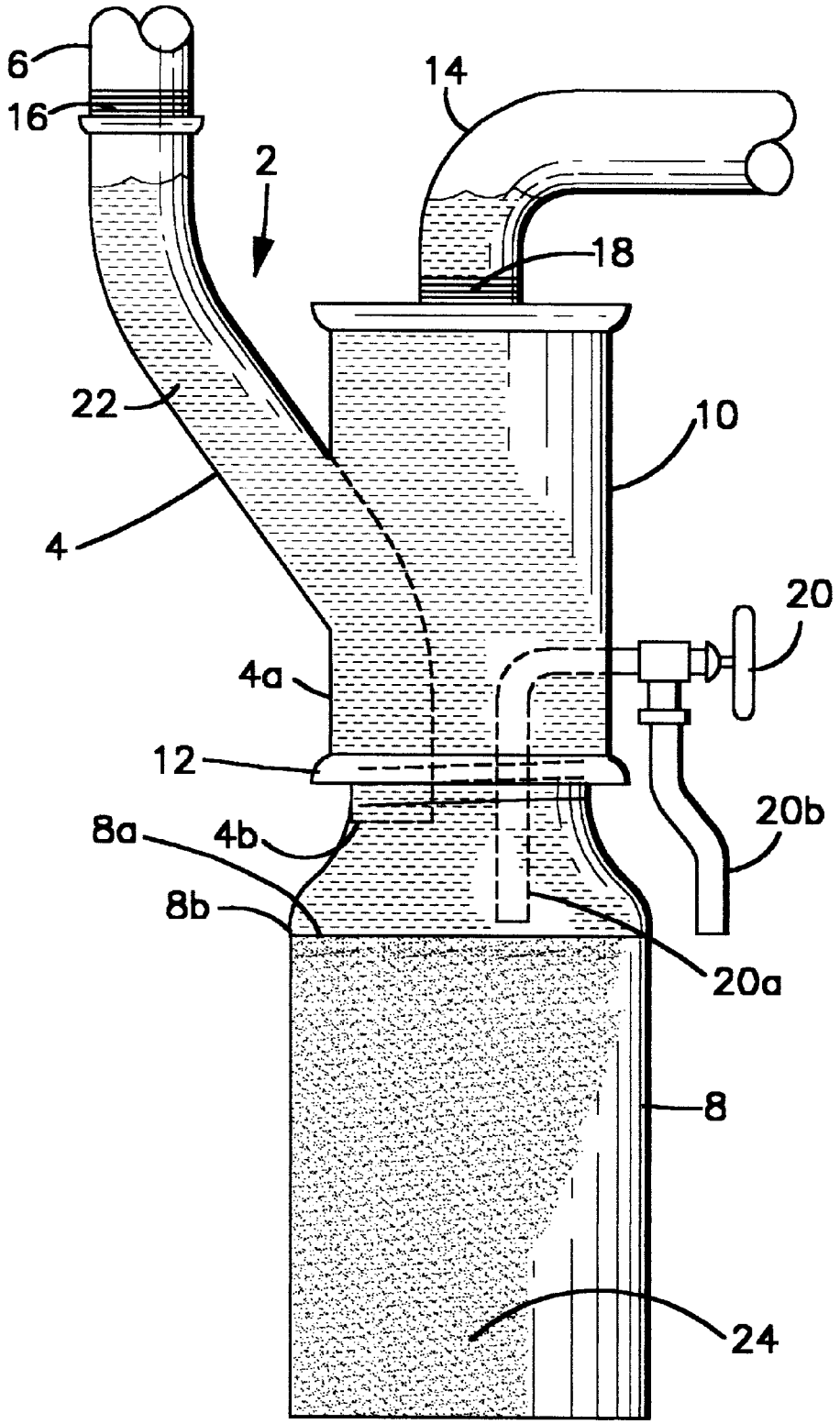
FIG. 2 is a schematic representation of the trap shown in FIG. 1, showing the trap to be full.

Reference is now made to FIG. 2, in which the trap 2 is shown with sediment 24 up to the fill line 8*a*. The bottle 8 is now ready to be disconnected from the second passageway 10 and removed therefrom.

Figure 3:
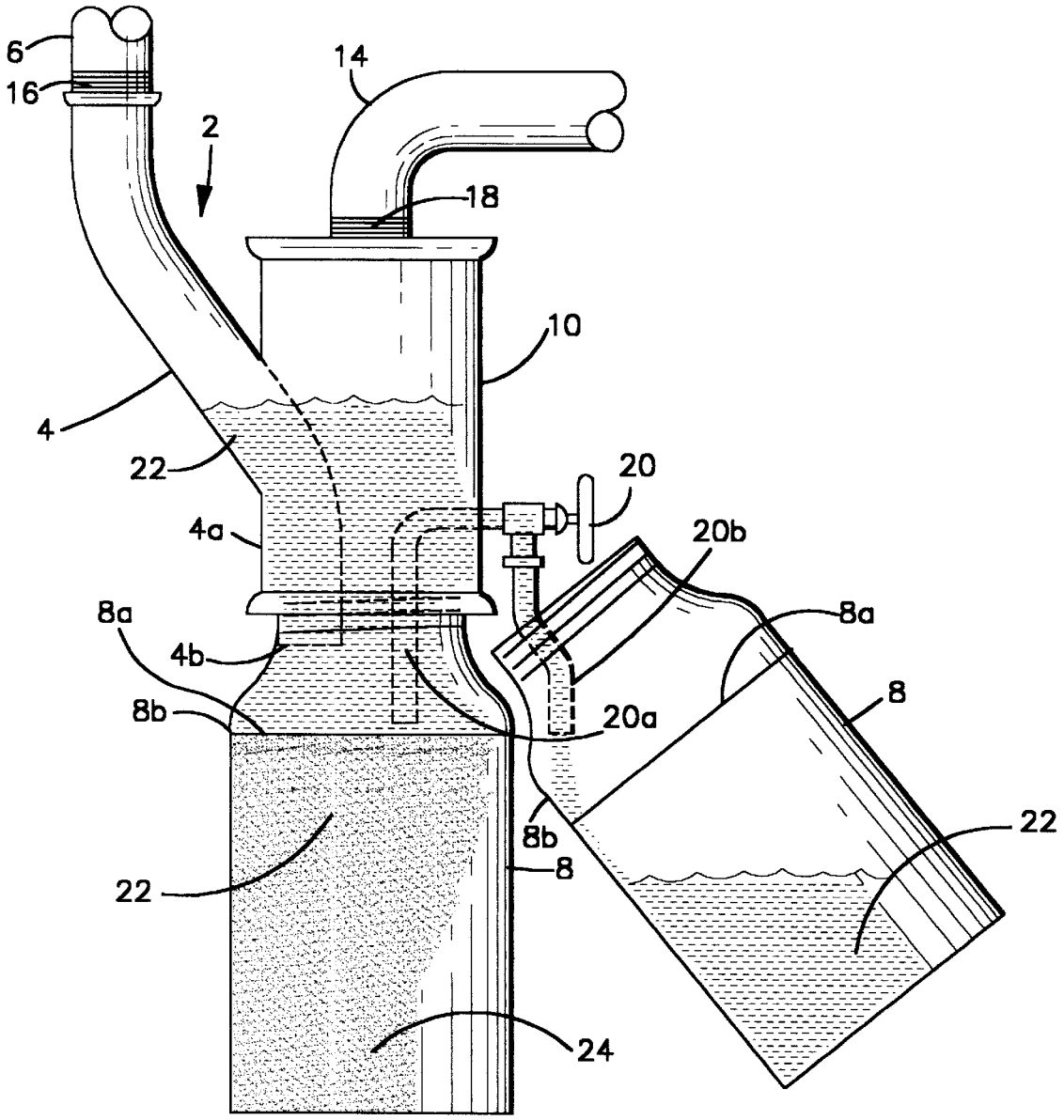
FIG. 3 is a schematic representation of the trap shown in FIG. 1, showing the trap being drained.

FIG. 3 shows water 22 being siphoned from the trap 2 into a second bottle 8 of the same construction as the first bottle 8.

Figure 4:
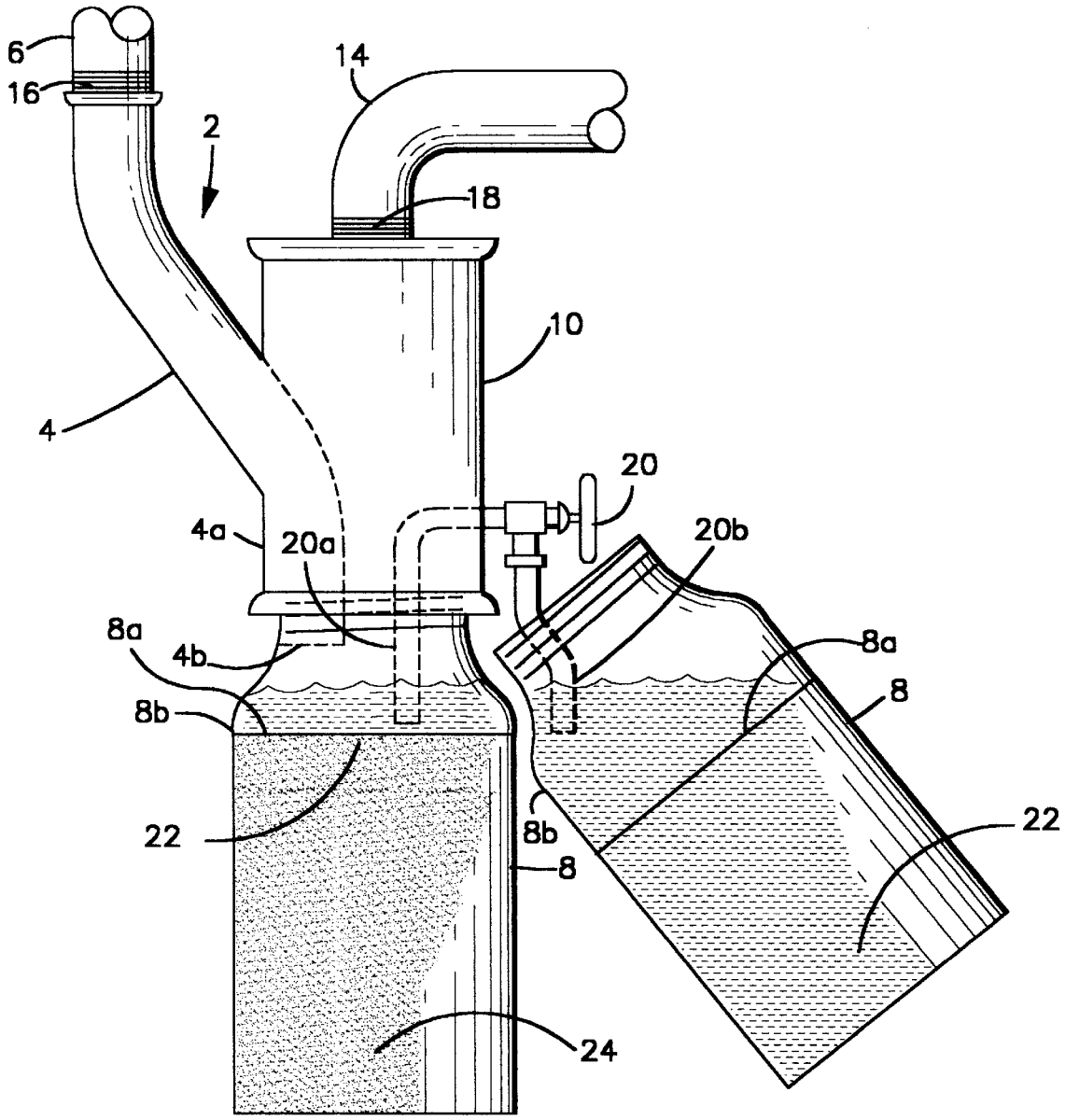
FIG. 4 is a schematic representation of the trap shown in FIG. 1, after the trap has been drained.

FIG. 4 depicts the situation after the water 22 has been drained from the trap 2 into the second bottle 8. The first and second bottles 8 are now ready to be exchanged.

Figure 5:
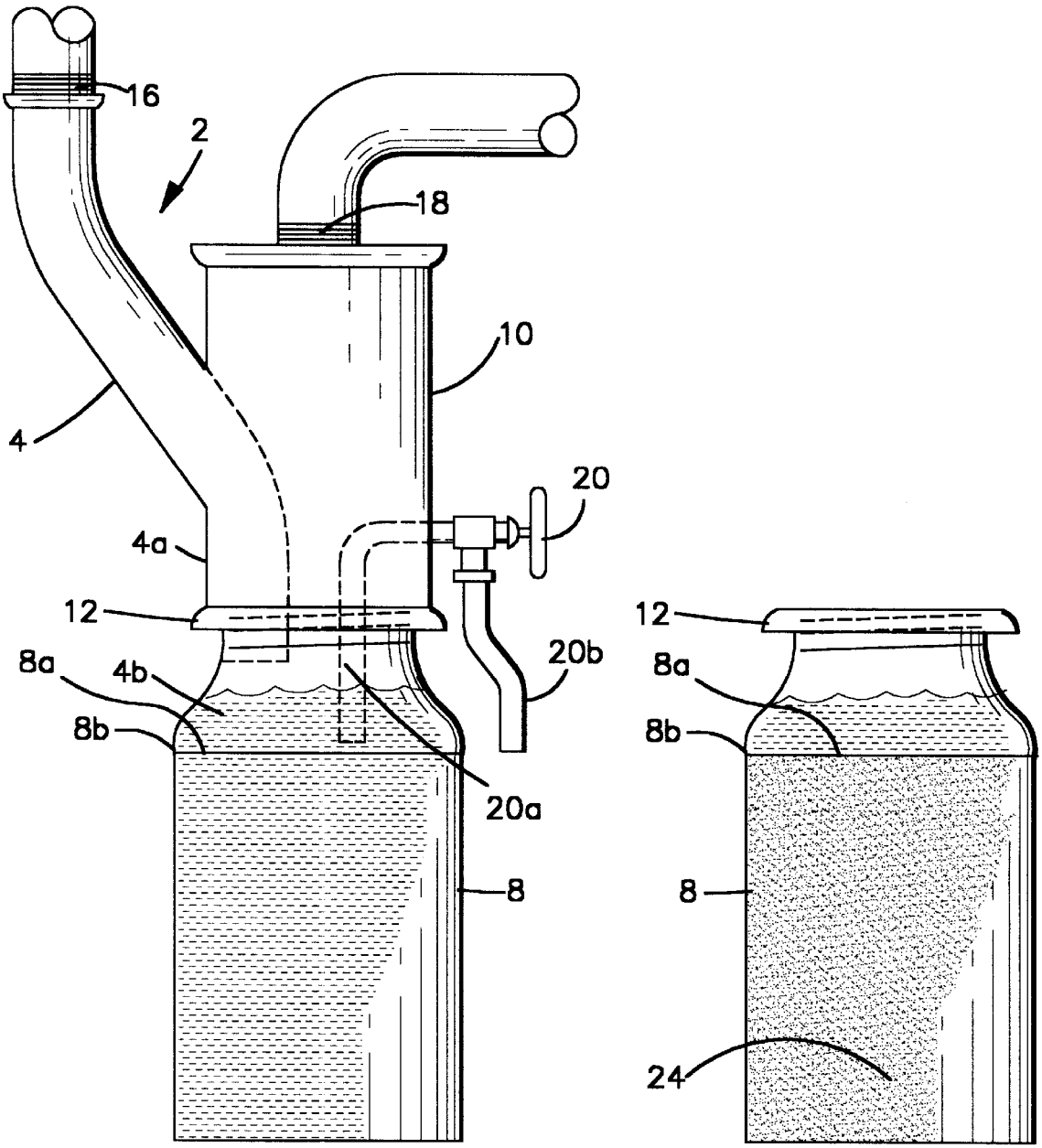
FIG. 5 is a schematic representation of the trap shown in FIG. 1, after a portion of the trap has been changed out.

FIG. 5 illustrates the situation after the exchange has been made. The plumbing trap 2 is now again ready for service under the sink (not shown).

The plumbing trap 2 is preferably made of plastic. Even more preferably, the trap 2 is made from a thermoplastic material by injection molding.

I claim:

1. A plumbing trap for attachment to a sink from which a high concentration of solids is discharged, the trap comprising:

(a) a vessel for receiving material discharged from the sink, and for separating the material into a lower solid phase and an upper liquid phase, the vessel including a level indicator, for indicating the appropriate level in the vessel to be reached by the lower solid phase before changing out the vessel;

(b) a first passageway for connecting the sink and the vessel to one another, for conveying material from the sink to the vessel;

(c) a second passageway for conveying the upper liquid phase from the vessel;

(d) means for connecting the vessel to the first and second passageways, and for disconnecting the vessel therefrom; and (e) means for draining the upper liquid phase from the vessel, the first passageway, and the second passageway;

wherein the means for draining the upper liquid phase from the vessel, the first vessel, the first passageway, and the second passageway include a siphon line disposed in the vessel and in the second passageway, a drain line external of the vessel and the second passageway, and valve connecting the siphon line and the drain line to one another.

2. The plumbing trap of claim 1, further comprising:

(f) an auxiliary vessel for receiving material discharged from the sink and for separating the material into a lower solid phase and an upper liquid phase, the auxiliary vessel including a level indicator for indicating the appropriate level in the auxiliary vessel to be reached by the lower solid phase before changing out the auxiliary vessel, the auxiliary vessel being constructed and arranged to replace the vessel when the vessel is changed out.

3. The plumbing trap of claim 1, wherein the means for connecting the vessel to the first and second passageways, and for disconnecting the vessel therefrom, include matching threads constructed and arranged to provide a threaded connection between the vessel and the first and second passageways.

4. The plumbing trap of claim 1, wherein the level indicator is a visual indicator.

5. The plumbing trap of claim 1, wherein the level indicator is a line inscribed on the vessel.

6. A plumbing trap for attachment to a sink from which a high concentration of solids is discharged, the trap comprising:

(a) a vessel for receiving material discharged from the sink, and for separating the material into a lower solid phase and an upper liquid phase;

(b) a first passageway for connecting the sink and the vessel to one another, for conveying material from the sink to the vessel;

(c) a second passageway for conveying the upper liquid phase from the vessel; and (d) means for draining the upper liquid phase from the vessel, the first passageway, and the second passageway;

wherein the means for draining the upper liquid phase from the vessel, the first passageway, and the second passageway include a siphon line disposed in the vessel and in the second passageway, a drain line external of the vessel and the second passageway, and valve connecting the siphon line and the drain line to one another.

7. A method for trapping solids in water discharged from a sink before the water is conveyed to a sewer system, the method comprising the steps of:

(a) providing a vessel for receiving the water and solids discharged from the sink, and for separating the water and solids into a lower solid phase and an upper liquid phase;

(b) providing a level indicator for the vessel, for indicating the appropriate level to be reached by the lower solid phase before changing out the vessel;

(c) conveying the water and solids from the sink to the vessel;

(d) conveying the upper liquid phase from the vessel;

(e) draining the upper liquid phase from the vessel when thr level of the solid phase has reached the level indicated by the levek indicator;

(f) providing an auxiliary vessel for receiving the water and solids discharged from the sink, and for separating the water and solids into a lower solid phase and an upper liquid phase;

(g) providing a level indicator for the auxiliary vessel, for indicsting the appropriate level to be reached by the lower solid phase before changing out the auxiliary vessel;

(h) exchanging the vessel for the auxiliary vessel;

(I) providing a passageway for conveying the upper liauid phase from the vessel;

(j) connecting the vessel to the passageway;

(k) draining the upper liquid phase from the passageway when the upper liquid phase is drained from the vessel; and (l) disconnecting the vessel from the passageway after draining the upper liquid phase from the vessel and the passageway.

8. The method of claim 7, further comprising the step of:

(m) connecting the auxiliary vessel to the passageway.

9. The method of claim 7, wherein the vessel is threadably connected to and disconnected from the passageway by matching threads on the vessel and on the passageway.

10. The method of claim 7, wherein the upper liquid phase is drained from the vessel by opening a valve connecting a siphon line disposed in the vessel and in the passageway to a drain line external of the vessel and the passageway.

11. The method of claim 7, wherein the level indicator is a visual indicator.

12. The method of claim 7, wherein the level indicator is a line inscribed on the vessel.

* * * * *